US009725221B2

(12) United States Patent
Housser

(10) Patent No.: US 9,725,221 B2
(45) **Date of Patent: *Aug. 8, 2017**

(54) FLUSH CUT TIE DEVICE

(71) Applicant: Stephen J. Housser, Listowel (CA)

(72) Inventor: Stephen J. Housser, Listowel (CA)

( * ) Notice: Subject to any disclaimer, the term of this patent is extended or adjusted under 35 U.S.C. 154(b) by 26 days.

This patent is subject to a terminal disclaimer.

(21) Appl. No.: 14/987,005

(22) Filed: Jan. 4, 2016

(65) Prior Publication Data

US 2016/0114949 A1 Apr. 28, 2016

Related U.S. Application Data

(63) Continuation of application No. 14/079,790, filed on Nov. 14, 2013, now Pat. No. 9,266,653.

(51) Int. Cl.
*B65D 63/10* (2006.01)
*B65D 63/00* (2006.01)

(52) U.S. Cl.
CPC ..... *B65D 63/1027* (2013.01); *B65D 63/00* (2013.01); *B65D 63/1063* (2013.01); *B65D 2563/108* (2013.01); *Y10T 24/1498* (2015.01)

(58) Field of Classification Search
CPC B65D 63/00; B65D 63/1027; B65D 63/1063; B65D 2563/108; Y10T 24/1498
See application file for complete search history.

(56) References Cited

U.S. PATENT DOCUMENTS 3,368,247 A 2/1968 Orban
3,892,011 A 7/1975 Kohke
5,839,169 A 11/1998 Edwards et al.
D444,054 S 6/2001 Bernard et al.
6,484,366 B1 11/2002 Deschenes et al.
6,701,579 B1 3/2004 De La Pena Razquin
7,316,375 B2 1/2008 Wakabayashi et al.
7,866,006 B2 1/2011 Laporte
8,387,215 B2 3/2013 Koncelik, Jr.
8,918,964 B2 * 12/2014 Iwahara ..... B60R 16/0215 24/16 PB
9,340,340 B2 * 5/2016 Beckman ..... B65D 63/109
2007/0033772 A1 * 2/2007 Brownlee ..... B65D 63/1072 24/16 PB
2008/0189916 A1 * 8/2008 Geiger ..... F16L 3/2332 24/16 R
2008/0250609 A1 * 10/2008 Franks ..... F16B 2/08 24/16 R
2012/0304422 A1 * 12/2012 Asai ..... B65D 63/1063 24/16 R
2012/0311823 A1 12/2012 Lee et al.
2016/0332791 A1 * 11/2016 Beckman ..... B65D 63/109

* cited by examiner

*Primary Examiner* — Robert J Sandy
*Assistant Examiner* — Louis Mercado

(57) ABSTRACT

A flush cut tie device facilitates flush trimming of excess after securing a tie device. The device includes a tie and a channel coupled to a first end of the tie. A projection is positioned in an interior of the channel. A plurality of ridges is positioned in spaced relationship along a length of the tie wherein one of the ridges is engaged by the projection when a second end of the tie is extended through the channel. A pair of grooves extends into opposite exterior faces of the channel wherein the grooves are positioned for facilitating engagement of clippers to the channel and cutting an end portion of the channel and the tie from a main portion of the channel. Thus, a cut end of the tie is flush with the main portion of the channel when the end portion of the channel is clipped.

5 Claims, 2 Drawing Sheets

FLUSH CUT TIE DEVICE

CROSS-REFERENCE TO RELATED APPLICATIONS

This application is a continuation of application Ser. No. 14/079,790, now U.S. Pat. No. 9,266,653, filed Nov. 14, 2013.

BACKGROUND OF THE DISCLOSURE

Field of the Disclosure

The disclosure relates to tie devices and more particularly pertains to a new tie device for facilitating flush trimming of excess after securing a tie device.

SUMMARY OF THE DISCLOSURE

An embodiment of the disclosure meets the needs presented above by generally comprising a tie and a channel coupled to a first end of the tie. A projection extends from a perimeter wall defining an interior of the channel wherein the projection is positioned in the interior of the channel. A plurality of ridges is positioned in spaced relationship along a length of the tie wherein one of the ridges is engaged by the projection when a second end of the tie is extended through the channel. A pair of grooves extends into opposite exterior faces of the channel wherein the grooves are positioned for facilitating engagement of clippers to the channel and cutting an end portion of the channel and the tie from a main portion of the channel. Thus, a cut end of the tie is flush with the main portion of the channel when the end portion of the channel is clipped.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
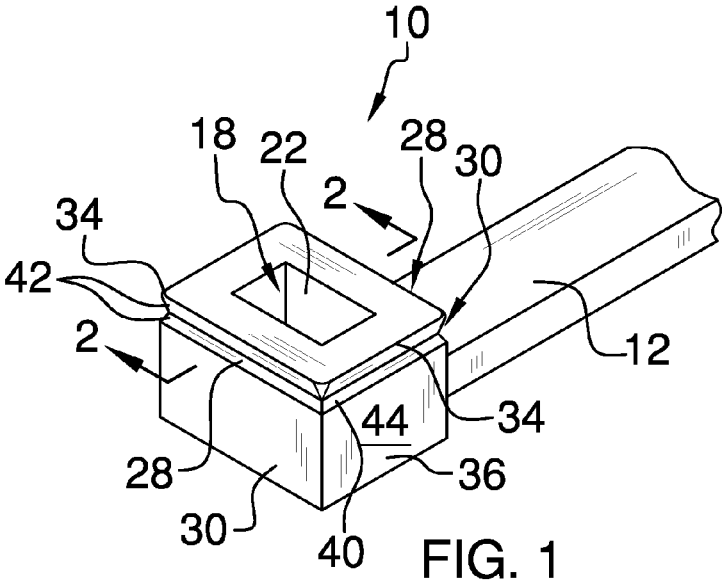
FIG. 1 is a top front side perspective view of a flush cut tie device according to an embodiment of the disclosure.
Figure 2:
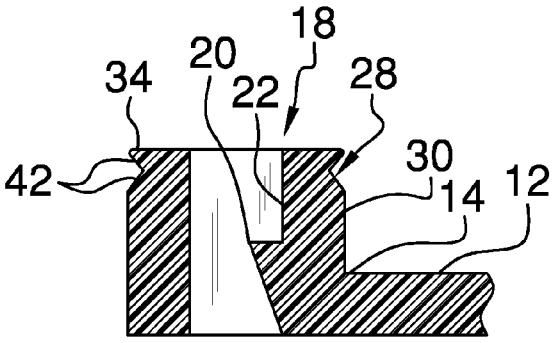
FIG. 2 is a cross-sectional view of an embodiment of the disclosure taken along line 2-2 of FIG. 1.
Figure 3:
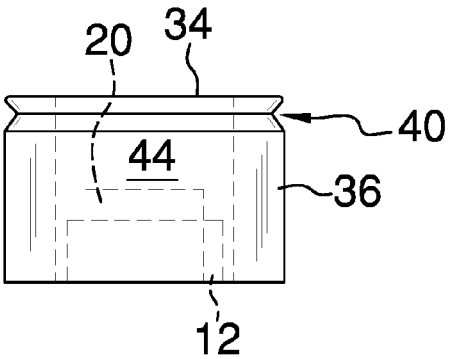
FIG. 3 is a front view of an embodiment of the disclosure.
Figure 4:
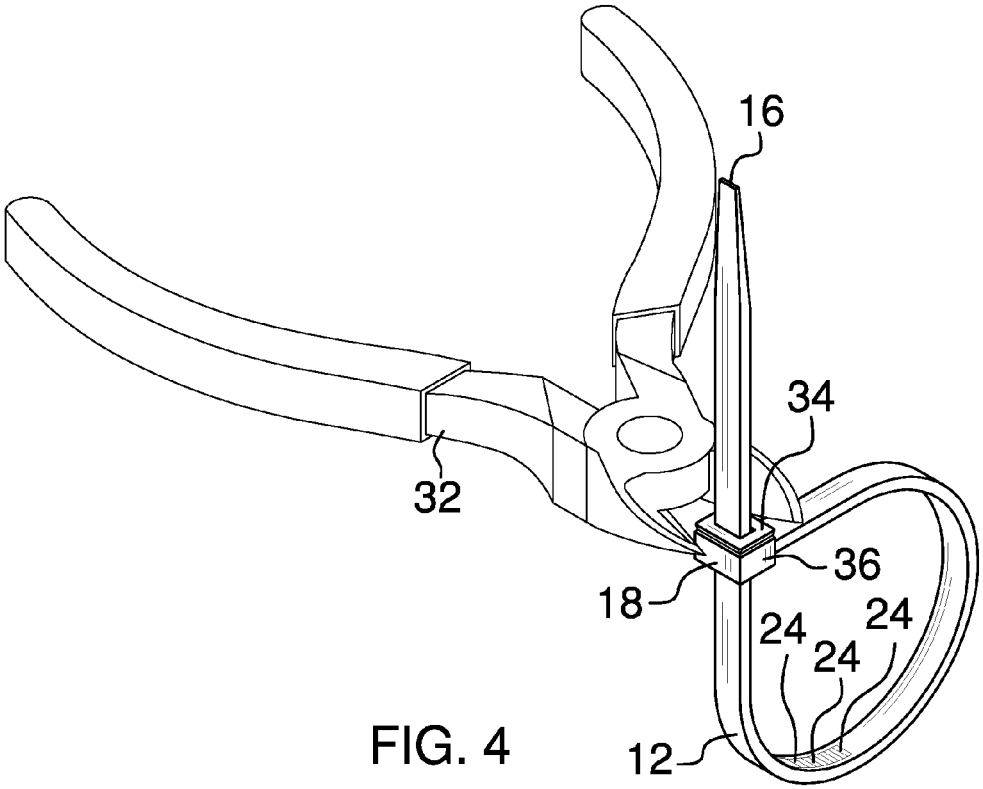
FIG. 4 is a top front side perspective view of an embodiment of the disclosure.
Figure 5:
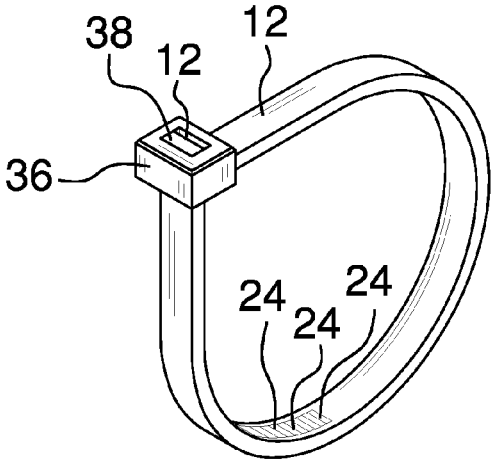
FIG. 5 is a top front side perspective view of an embodiment of the disclosure after trimming.

With reference now to the drawings, and in particular to FIGS. 1 through 5 thereof, a new tie device embodying the principles and concepts of an embodiment of the disclosure and generally designated by the reference numeral 10 will be described.

As best illustrated in FIGS. 1 through 5, the flush cut tie device 10 generally comprises a tie 12 having a first end 14 and a second end 16. A channel 18 is coupled to the first end 14 of the tie 12. A projection 20 extends from a perimeter wall 22 defining an interior of the channel 18 wherein the projection 20 is positioned in the interior of the channel 18. A plurality of ridges 24 is positioned in spaced relationship along a length of the tie 12 wherein a selectable one of the ridges 24 is engaged by the projection 20 when the second end 16 of the tie 12 is extended through the channel 18 wherein the projection 20 prevents reverse motion of the tie 12 to pull the second end 16 back out of the channel 18. Each of a pair of grooves 28 extends into opposite exterior faces 30 of the channel 18 wherein the grooves 28 are positioned for facilitating engagement of clippers 32 to the channel 18 and cutting an end portion 34 of the channel 18 and the tie 12 from a main portion 36 of the channel 18 wherein a cut end 38 of the tie 12 is flush with the main portion 36 of the channel 18 when the end portion 34 of the channel 18 is clipped. The grooves 28 may be joined forming a single circumferential groove 40 extending fully around the channel 18. The single circumferential groove 40 is defined by a pair of straight angled faces 42 such that the single circumferential groove 40 tapers extending inwardly from an outer surface 44 of the channel 18. The projection 20 is positioned in the main portion 36 of the channel 18 to prevent interference with engagement to the ridge 24 when the tie is clipped.

In use, the tie 12 is used in conventional fashion. When set, the excess of the tie 12 extending from the second end 16 to the channel 18 may be easily trimmed by the clippers 32 engaging the grooves 28 or selectable sides of the single circumferential groove 40. Cutting with the grooves 28 or groove 40 provides the cut end 38 will be flush with the main portion 36 of the channel 18 after the cut.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A flush cut tie device comprising:

a tie having a first end and a second end;

a channel coupled to said first end of said tie;

a projection extending from a perimeter wall defining an interior of said channel wherein said projection is positioned in said interior of said channel;

a plurality of ridges positioned in spaced relationship along a length of said tie wherein a selectable one of said ridges is engaged by said projection when said second end of said tie is extended through said channel wherein said projection prevents reverse motion of said tie to pull said second end back out of said channel; and at least one groove extending into an exterior face of a perimeter wall defining said channel such that said groove is positioned perpendicularly relative to said channel wherein said groove is positioned for facilitating engagement of clippers to said channel by insertion of the clippers into said groove and cutting an end portion of said channel and said tie from a main portion of said channel wherein a cut end of said tie is flush with said main portion of said channel when said end portion of said channel is clipped.

2. The device of claim 1, further comprising said at least one groove being defined by a pair of straight angled faces extending into said exterior face of said perimeter wall such that said groove tapers extending inwardly from said exterior face of said perimeter wall towards said interior of said channel.

3. The device of claim 1, further comprising said projection being positioned in said main portion of said channel.

4. A flush cut tie device comprising:

a tie having a first end and a second end;

a channel coupled to said first end of said tie;

a projection extending from a perimeter wall defining an interior of said channel wherein said projection is positioned in said interior of said channel;

a plurality of ridges positioned in spaced relationship along a length of said tie wherein a selectable one of said ridges is engaged by said projection when said second end of said tie is extended through said channel wherein said projection prevents reverse motion of said tie to pull said second end back out of said channel; and a pair of grooves extending into opposite exterior faces of said perimeter wall defining said channel wherein said grooves are positioned for facilitating engagement of clippers to said channel by insertion of the clippers into the grooves and cutting an end portion of said channel and said tie from a main portion of said channel wherein a cut end of said tie is flush with said main portion of said channel when said end portion of said channel is clipped, each said groove being defined by a pair of straight angled faces such that each said groove tapers extending inwardly from said exterior face of said perimeter wall towards said interior of said channel; and wherein said projection being positioned in said main portion of said channel.

5. The device of claim 4, further comprising said pair of grooves being coplanar.

* * * * *